US006719856B2

(12) United States Patent
Takahashi et al.

(10) Patent No.: US 6,719,856 B2
(45) Date of Patent: Apr. 13, 2004

(54) TITANIUMS HAVING EXCELLENT IMPACT RESISTANCE AND MANUFACTURING METHODS

(75) Inventors: Kazuhiro Takahashi, Hikari (JP); Motomi Masaki, Tokyo (JP); Kazuyuki Miura, Tokyo (JP); Tatsuo Ohya, Tokyo (JP)

(73) Assignees: Nippon Steel Corporation, Tokyo (JP); MIC Japan, Ltd., Tokyo (JP)

( * ) Notice: Subject to any disclaimer, the term of this patent is extended or adjusted under 35 U.S.C. 154(b) by 0 days.

(21) Appl. No.: 09/919,392

(22) Filed: Jul. 31, 2001

(65) Prior Publication Data

US 2003/0062102 A1 Apr. 3, 2003

(51) Int. Cl.[7] ..... C22C 14/00
(52) U.S. Cl. ..... 148/421; 148/670
(58) Field of Search ..... 148/670, 421

(56) References Cited

U.S. PATENT DOCUMENTS 5,666,841 A * 9/1997 Seeger et al. ..... 72/110

FOREIGN PATENT DOCUMENTS

GB 1304572 * 1/1973

* cited by examiner

*Primary Examiner*—Andrew L. Oltmans
(74) *Attorney, Agent, or Firm*—Kenyon & Kenyon

(57) ABSTRACT

Titaniums having excellent impact resistance are manufactured by methods that attain good cold workability by controlling the concentrations of oxygen, nitrogen, carbon and iron contained in ordinary pure titaniums in the desired range, applying combinations of preliminary working and annealing before or during the forming process, and controlling the Vickers hardness in the cross-sectional area to the desired range according to the concentrations, without adding aluminum, molybdenum, vanadium or other alloying elements.

4 Claims, 1 Drawing Sheet

Areas covered by equations (1),(2) and (3)

Condition of the Area Struck in the Drop Weight Test :

▼ : The falling weight passed through the specimen.

△ : The falling weight did not pass through the specimen but produced a crack.

○ : The falling weight neither passed through the specimen nor produced a crack.

Areas covered by equations (1),(2) and (3)

Condition of the Area Struck in the Drop Weight Test :

▼ : The falling weight passed through the specimen.

△ : The falling weight did not pass through the specimen but produced a crack.

○ : The falling weight neither passed through the specimen nor produced a crack.

TITANIUMS HAVING EXCELLENT IMPACT RESISTANCE AND MANUFACTURING METHODS

BACKGROUND OF THE INVENTION

1. Field of the Invention

This invention relates to titaniums having excellent impact resistance and its manufacturing method. Here, impact resistance is a property to stand impact applied from outside. Impact resistance is required of materials protecting human bodies or important products, wholly or partly, such as shields, helmets and bulletproof vests.

2. Description of the Prior Art

High-strength alloy steels and titanium alloys with high specific strength are used for products requiring high impact resistance, with a view to achieving weight savings. To attain this goal, warm or hot forming and low-speed forming have been employed.

SUMMARY OF THE INVENTION

Although the conventional processes described above improve formability, production efficiency is not high because processes to heat, keep the desired temperature, or descale after forming are involved. Besides, titanium alloys are more expensive than ordinary pure titaniums because vanadium, molybdenum or other alloying elements are added.

Although, in addition, titanium alloys have high strength, they do not have good impact resistance to high-speed impacts.

In order to eliminate the above shortcomings, an object of this invention is to provide pure titaniums having higher impact resistance than the conventional ones and a method for manufacturing such titaniums.

Another object of this invention is to provide pure titaniums with higher impact resistance and methods for manufacturing such titaniums at low cost.

Other objects of this invention are explicitly described in the following.

The studies made by the inventors to achieve the above objects led to a discovery that titaniums having excellent impact resistance can be obtained by controlling the quantities of oxygen, nitrogen and carbon contained in titaniums and applying work-hardening.

The titaniums according to this invention having an excellent impact resistance have a feature that the total content (S) of the contents of (O+N+C) is between 0.04 and 0.27 mass percent, the iron concentration is not greater than 0.1 mass percent, with the balance consisting of titanium and unavoidable impurities, and the Vickers hardness Hv* in the cross-sectional area satisfies one of the following equations (1), (2) and (3):

When $0.04 \leqq S \leqq 0.09$ (mass percent)

$$150 \leqq Hv^* \leqq 400 \times S + 175 \quad (1)$$

When $0.09 \leqq S \leqq 0.20$ (mass percent)

$$510 \times S + 104 \leqq Hv^* \leqq 400 \times S + 175 \quad (2)$$

When $0.20 \leqq S \leqq 0.27$ (mass percent)

$$510 \times S + 104 \leqq Hv^* \leqq 255 \quad (3)$$

wherein S: [O]+[N]+[C] (mass percent)

Hv*: Vickers hardness in the cross-sectional area of the work-hardened product

A method for manufacturing the above titaniums according to this invention comprises applying preliminary working prior to forming so that the Vickers hardness Hv* in the cross-sectional area of the formed material satisfies one of the equations (1), (2) and (3) described above.

The titanium before the application of preliminary working may be in any condition; i.e., as hot-rolled or otherwise hot-worked, as cold-rolled or otherwise cold-worked, or annealed after such hot- or cold-working.

Another method for manufacturing the above titaniums according to this invention comprises applying, as said preliminary working prior to forming, rolling or leveling or both of them using rolls in a direction perpendicular to the direction of hot- or cold-rolling so that the Vickers hardness Hv* in the cross-sectional area of the formed material satisfies one of the equations (1), (2) and (3) described above.

Still another method for manufacturing the above titaniums according to this invention comprises applying annealing before or during forming so that the Vickers hardness Hv* in the cross-sectional area of the formed material satisfies one of the equations (1), (2) and (3) described above.

Oxygen, nitrogen and carbon are ordinary components of industrial pure titaniums contained usually in the range of 0.04 to 0.4, 0.01 to 0.02 and 0.001 to 0.02 mass percent respectively. This invention controls the contents of the oxygen, nitrogen and carbon not individually but in terms of the total content (S).

Here, preliminary working is a step indispensable to this invention that plays an important role in imparting the desired impact resistance to formed products. This step comprises cold rolling or leveling hot-rolled, hot- and cold-rolled, or hot- and cold-rolled and annealed sheets. The rate of cold reduction in preliminary working is not more than 70 percent or preferably between 10 and 50 percent. Leveling is applied using a tension leveler or a bending leveler.

Preliminary working is not limited to cold rolling and leveling. Forging and other method are also applicable. Although, a temperature near room temperature is preferable to preliminary working, with the prevention of oxidation in mind, there is no need to limit the temperature range.

DETAILED DESCRIPTION OF THE INVENTION

Figure 1:
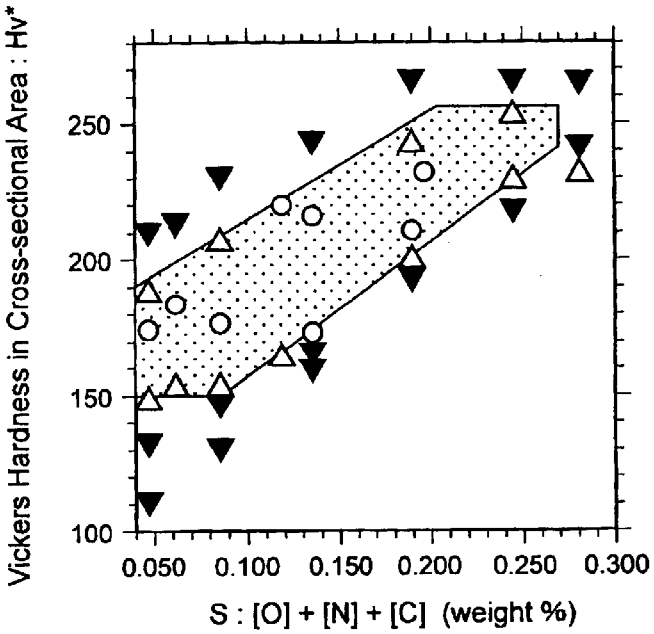
FIG. 1 shows the relationship between the total content (S) of oxygen, nitrogen and carbon, Vickers hardness Hv* in the cross-sectional area after work-hardening, and impact resistance obtained in a drop-weight test.

FIG. 1 shows the range of concentration (S=[O]+[N]+[C] in mass percent) and the range of Vickers hardness (Hv*) in the cross-sectional area after work-hardening according to this invention. The impact resistance shown in FIG. 1 was evaluated from the results of a drop-weight test in which a weight weighing 60 kg and having a projection (2 mm R and 4 mm diameter ×20 mm high) at the lower end thereof was dropped from a height of 1.5 m. The specimens were 3.3 mm thick sheets roller-bent with a radius of 150 R, whereas the weight was dropped to strike the protruding side of the curved specimens.

The titanium specimens subjected to the above test were prepared and controlled as descried below.

First, titaniums of different compositions were hot-rolled to 3.3 mm thick sheets. Some of the sheets were also cold-rolled and annealed. All sheets thus obtained were subjected to preliminary working by cold rolling with varying reduction ratios (0 to approximately 70 percent) and formed by roller bending to a curvature of 150 R.

The bending machine used for roller bending had rolls arranged in a zigzag fashion. Annealing in a high vacuum softened some of the bent specimens.

Thus, the test specimens had varying compositions, worked and annealed in varying fashions, and had varying Vickers hardness in the cross-sectional area. They were either as-formed or as-annealed, all having metallic colors without oxide scale on the surface.

The regions struck in the drop-weight test described earlier were visually observed and classified into three types: the projection on the weight penetrated (▼), the projection on the weight did not penetrate but produced crack (Δ), and the projection on the weight did neither penetrate nor produced crack (○).

FIG. 1 was obtained by plotting the specimens on which the projection on the weight did not penetrate (Δ and ○). An enclosed region in FIG. 1 can be expressed by equations (1), (2) and (3). That is, no penetration occurred when the total concentration S of oxygen, nitrogen and carbon, which have relatively great effects on hardness, and Vickers hardness Hv* in the cross-sectional area are in the ranges defined by the following equations (1), (2) and (3). Accordingly, it was found that When $0.04 \leqq S \leqq 0.09$ (mass percent)

$$150 \leqq Hv^* \leqq 400 \times S + 175 \quad (1)$$

When $0.09 \leqq S \leqq 0.20$ (mass percent)

$$510 \times S + 104 \leqq Hv^* \leqq 400 \times S + 175 \quad (2)$$

When $0.20 \leqq S \leqq 0.27$ (mass percent)

$$510 \times S + 104 \leqq Hv^* \leqq 255 \quad (3)$$

Above the region defined by equations (1), (2) and (3), work-hardening is excessive and ductility is insufficient, as a result of which the specimens whose S and Hv* are not inside the enclosed region cannot change their shape when subjected to impact. Then, crack occurs and propagates, thereby allowing the weight to penetrate into the specimen. Below the region defined by equations (1), (2) and (3), on the other hand, work-hardening is insufficient to build up enough deformation resistance in the specimen. The resulting localized deformation leads to the penetration of the weight. In the titaniums according to this invention, therefore, the total concentration S of oxygen, nitrogen and carbon (mass percent) and Vickers hardness Hv* in the cross-sectional area after work-hardening are confined to those defined by equations (1), (2) and (3).

Keeping the total concentration S of oxygen, nitrogen and carbon below 0.04 mass percent requires greater purification in smelting and vacuum melting than ordinary industrial pure titaniums do. As such greater purification is costly, the total concentration S in the titaniums according to this invention is limited to 0.04 mass percent or above.

If the total concentration S exceeds 0.27 mass percent and the iron concentration exceeds 0.1 mass percent, application of work-hardening does not provide any significant improvement in impact resistance. Besides, titaniums become so hard that cold working and forming become difficult. Therefore, the total concentration S and the iron concentration in the titaniums according to this invention are limited to not more than 0.27 mass percent and not more than 0.1 mass percent, respectively.

The same drop-weight test was applied to two titanium alloys Ti-3Al-2.5V and Ti-15V-3Cr-3Sn-3Al of the same thickness and shape as those of the specimens described earlier. All specimens of both titanium alloys developed cracks, though some were penetrated and some were not. Accordingly, the impact resistance of the titaniums according to this invention is considered to be equal to or greater than that of ordinary titanium alloys.

According to this invention, as is obvious from the above, titaniums with impact resistance equal to or greater than that of titanium alloys can be obtained by a relatively simple method that attains cold workability by limiting the concentrations of oxygen, nitrogen, carbon and iron contained in pure titanium and controls Vickers hardness in the cross-sectional area of work-hardened titaniums to within the desired range.

Cold working or leveling applied as preliminary working is applied in a direction perpendicular to the direction of previous rolling. For example, a rolled or an annealed strip is cut into a sheet of appropriate size and cold rolling is applied as a preliminary working in a direction perpendicular to the direction in which the strip was rolled. This perpendicular cold rolling reduces the anisotropy of the titanium sheet and thereby improves its press-formability and impact resistance. Thus it is preferable for the titaniums of this invention to have rolling or leveling, by means of rolls, applied in a direction perpendicular to the direction of preceding hot- or cold-rolling, as a preliminary working to the sheet to be formed.

If, in addition, it is necessary to control the Vickers hardness Hv of the final product, annealing may be applied in the course of the forming process, at 350 to 700° C. for 10 minutes to 2 hours, preferably at 400 to 600° C. for 1 to 2 hours.

EXAMPLES

Now the effect of this invention will be described by reference to some embodiments of this invention.

Tables 1 and 3 show the compositions and Vickers hardness in the cross-sectional area of titaniums prior to preliminary working, while Tables 2 and 4 show the shape, combinations of preliminary working, forming and annealing (the rate of reduction and direction of preliminary cold rolling and conditions of annealing), Vickers hardness Hv* in the cross-sectional area of products (after work-hardening) and the condition of the regions struck in the drop-weight test.

The Vickers hardness in the cross-sectional area as used here is the mean value of the values measured at five each points in the direction of rolling (direction L) and the direction perpendicular thereto (direction C) at half and one-fourth the thickness of the specimens, twenty points in total. The load applied in the test was 9.8 N (1 kgf).

The titaniums shown in Tables 1 and 3 were prepared as described below. First, titaniums of varying compositions were hot-rolled so that final products would have a thickness of 3.3 mm. Some of the sheets were further cold-rolled and annealed. Then, the sheets were subjected to preliminary working consisting of cold rolling of varying degrees (0 to approximately 70 percent) and, then, formed with a radius of 150 R by roller bending. The cold rolling was applied in the same direction as that of strip rolling and the direction perpendicular thereto. The bending machine used for roller bending had rolls arranged in a zigzag fashion. Some of the bent specimens were annealed in a high vacuum, either at the end or in the middle of forming. All specimens thus prepared had metallic colors without oxide scale on the surface.

TABLE 1

| No. | Composition (Mass Percent) O | N | C | Fe | Other Alloying Elements | Total Consentration of O, N and C; S [O] + [N] + [C] (Mass Percent) | Vickers Hardness in Cross-sectional Area of As-annealed Sheet before Preforming |
|---|---|---|---|---|---|---|---|
| 1 | 0.039 | 0.003 | 0.004 | 0.032 | None | 0.046 | 114 |
| 2 | " | " | " | " | " | " | 115 |
| 3 | " | " | " | " | " | " | 117 |
| 4 | " | " | " | " | " | " | 114 |
| 5 | " | " | " | " | " | " | 116 |
| 6 | 0.051 | 0.005 | 0.005 | 0.032 | " | 0.062 | 121 |
| 7 | " | " | " | " | " | " | 120 |
| 8 | " | " | " | " | " | " | 124 |
| 9 | 0.076 | 0.004 | 0.005 | 0.040 | " | 0.085 | 133 |
| 10 | " | " | " | " | " | " | 133 |
| 11 | " | " | " | " | " | " | 130 |
| 12 | " | " | " | " | " | " | 138 |
| 13 | " | " | " | " | " | " | 135 |
| 14 | 0.108 | 0.005 | 0.005 | 0.045 | " | 0.118 | 151 |
| 15 | " | " | " | " | " | " | 152 |
| 16 | 0.125 | 0.004 | 0.005 | 0.041 | " | 0.134 | 158 |
| 17 | " | " | " | " | " | " | 157 |
| 18 | " | " | " | " | " | " | 159 |
| 19 | " | " | " | " | " | " | 156 |
| 20 | 0.182 | 0.006 | 0.006 | 0.046 | " | 0.188 | 187 |
| 21 | " | " | " | " | " | " | 185 |
| 22 | " | " | " | " | " | " | 188 |
| 23 | " | " | " | " | " | " | 187 |
| 24 | 0.231 | 0.008 | 0.005 | 0.075 | " | 0.244 | 210 |
| 25 | " | " | " | " | " | " | 209 |
| 26 | " | " | " | " | " | " | 212 |
| 27 | 0.268 | 0.007 | 0.006 | 0.080 | " | 0.281* | 228 |
| 28 | " | " | " | " | " | " | 225 |

*: Outside the scope of this invention

TABLE 2

| No. | Condition of Specimens for Drop Weight Test: Shape | Combination of Preforming, Forming and Annealing (Cold Rolling Reduction Ratio #2, Annealing Conditions) | Vickers Hardness in Cross-sectional Area; Hv* | Range of Hv* in Equation (1) or (2) | Condition of Area Struck in Drop Weight Test #1 | Remarks |
|---|---|---|---|---|---|---|
| 1 | 3.3 mm thick, Formed with a curvature of 150R | Cold reduced 10% → As-bent | 132* | 150~193 | ▼ | T.C. |
| 2 | 3.3 mm thick, Formed with a curvature of 150R | Cold reduced 20% → As-bent | 150 | " | Δ | E.I. |
| 3 | 3.3 mm thick, Formed with a curvature of 150R | Cold reduced 40% → As-bent | 175 | " | ○ | E.I. |
| 4 | 3.3 mm thick, Formed with a curvature of 150R | Cold reduced 50% → As-bent | 190 | " | Δ | E.I. |
| 5 | 3.3 mm thick, Formed with a curvature of 150R | Cold reduced 70% → As-bent | 210* | " | ▼ | T.C. |
| 6 | 3.3 mm thick, Formed with a curvature of 150R | Cold reduced 20% → As-bent | 156 | 150~200 | Δ | E.I. |
| 7 | 3.3 mm thick, Formed with a curvature of 150R | Cold reduced 40% → As-bent | 184 | " | ○ | E.I. |
| 8 | 3.3 mm thick, Formed with a curvature of 150R | Cold reduced 70% → As-bent | 213* | " | ▼ | T.C. |
| 9 | 3.3 mm thick, Formed with a curvature of 150R | No C.R. → As-bent | 145* | 150~209 | ▼ | T.C. |
| 10 | 3.3 mm thick, Formed with a curvature of 150R | Cold reduced 10% → As-bent | 153 | " | Δ | E.I. |
| 11 | 3.3 mm thick, Formed with a curvature of 150R | Cold reduced 20% → As-bent | 177 | " | ○ | E.I. |
| 12 | 3.3 mm thick, Formed with a curvature of 150R | Cold reduced 50% → As-bent | 208 | " | Δ | E.I. |
| 13 | 3.3 mm thick, Formed with a curvature of 150R | Cold reduced 70% → As-bent | 230* | " | ▼ | T.C. |
| 14 | 3.3 mm thick, Formed with a curvature of 150R | Cold reduced 10% → As-bent | 166 | 164~222 | Δ | E.I. |
| 15 | 3.3 mm thick, Formed with a curvature of 150R | Cold reduced 40% → As-bent | 220 | " | ○ | E.I. |
| 16 | 3.3 mm thick, Formed with a curvature of 150R | No C.R. → As-bent | 165* | 172~229 | ▼ | T.C. |

TABLE 2-continued

| No. | Condition of Specimens for Drop Weight Test: Shape | Combination of Preforming, Forming and Annealing (Cold Rolling Reduction Ratio #2, Annealing Conditions) | Vickers Hardness in Cross-sectional Area; Hv* | Range of Hv* in Equation (1) or (2) | Condition of Area Struck in Drop Weight Test #1 | Remarks |
|---|---|---|---|---|---|---|
| 17 | 3.3 mm thick, Formed with a curvature of 150R | Cold reduced 10% → As-bent | 173 | " | ○ | E.I. |
| 18 | 3.3 mm thick, Formed with a curvature of 150R | Cold reduced 50% → As-bent | 216 | " | ○ | E.I. |
| 19 | 3.3 mm thick, Formed with a curvature of 150R | Cold reduced 70% → As-bent | 243* | " | ▼ | T.C. |
| 20 | 3.3 mm thick, Formed with a curvature of 150R | Cold reduced 10% → As-bent | 201 | 200~250 | Δ | E.I. |
| 21 | 3.3 mm thick, Formed with a curvature of 150R | Cold reduced 20% → As-bent | 210 | " | ○ | E.I. |
| 22 | 3.3 mm thick, Formed with a curvature of 150R | Cold reduced 50% → As-bent | 244 | " | Δ | E.I. |
| 23 | 3.3 mm thick, Formed with a curvature of 150R | Cold reduced 70% → As-bent | 265* | " | ▼ | T.C. |
| 24 | 3.3 mm thick, Formed with a curvature of 150R | Cold reduced 10% → As-bent | 230 | 228~255 | Δ | E.I. |
| 25 | 3.3 mm thick, Formed with a curvature of 150R | Cold reduced 20% → As-bent | 254 | " | Δ | E.I. |
| 26 | 3.3 mm thick, Formed with a curvature of 150R | Cold reduced 50% → As-bent | 265* | " | ▼ | T.C. |
| 27 | 3.3 mm thick, Formed with a curvature of 150R | Cold reduced 10% → As-bent | 240 | Not applied | ▼ | T.C. |
| 28 | 3.3 mm thick, Formed with a curvature of 150R | Cold reduced 20% → As-bent | 264 | " | ▼ | T.C. |

*: Outside the scope of this invention
T.C.: Tested for comparison
E.I.: Embodiment of the invention

TABLE 3

| No. | Composition (Mass Percent): O | N | C | Fe | Other Alloying Elements | Total Consentration of O, N and C; S [O] + [N] + [C] (Mass Percent) | Vickers Hardness in Cross-sectional Area of As-annealed Sheet before Preforming |
|---|---|---|---|---|---|---|---|
| 29 | 0.039 | 0.003 | 0.004 | 0.032 | None | 0.046 | 115 |
| 30 | 0.076 | 0.004 | 0.005 | 0.040 | " | 0.085 | 133 |
| 31 | 0.125 | 0.004 | 0.005 | 0.004 | " | 0.134 | 158 |
| 32 | 0.182 | 0.006 | 0.006 | 0.046 | " | 0.188 | 189 |
| 33 | 0.231 | 0.008 | 0.005 | 0.075 | " | 0.244 | 212 |
| 34 | 0.268 | 0.007 | 0.006 | 0.080 | " | 0.281* | 227 |
| 35 | 0.184 | 0.006 | 0.005 | 0.092 | None | 0.195 | 196 |
| 36 | 0.201 | 0.006 | 0.005 | 0.155* | " | 0.212 | 230 |
| 37 | 0.182 | 0.005 | 0.006 | 0.198* | " | 0.193 | 241 |
| 38 | 0.125 | 0.004 | 0.005 | 0.041 | None | 0.134 | 157 |
| 39 | " | " | " | " | " | " | " |
| 40 | " | " | " | " | " | " | 158 |
| 41 | " | " | " | " | " | " | 156 |
| 42 | " | " | " | " | " | " | 157 |
| 43 | " | " | " | " | " | " | 159 |
| 44 | " | " | " | " | " | " | 159 |
| 45 | " | " | " | " | " | " | 158 |
| 46 | 0.108 | 0.005 | 0.005 | 0.045 | " | 0.118 | 150 |
| 47 | 0.070 | 0.005 | 0.018 | 0.060 | 3Al-2.5V* | — | 230 |
| 48 | 0.095 | 0.015 | 0.018 | 0.077 | 15V-3Cr-3Sn-3Al* | — | 249 |

*: Outside the scope of this invention

TABLE 4

| No. | Condition of Specimens for Drop Weight Test: Shape | Combination of Preforming, Forming and Annealing (Cold Rolling Reduction Ratio #2, Annealing Conditions) | Vickers Hardness in Cross-sectional Area; Hv* | Range of Hv* in Equation (1) or (2) | Condition of Area Struck in Drop Weight Test #1 | Remarks |
|---|---|---|---|---|---|---|
| 29 | 3.3 mm thick, Formed with a curvature of 150R | Bent → Annealed at 580° C. for one hour | 110* | 150~193 | ▼ | T.C. |

TABLE 4-continued

| No. | Condition of Specimens for Drop Weight Test: Shape | Combination of Preforming, Forming and Annealing (Cold Rolling Reduction Ratio #2, Annealing Conditions) | Vickers Hardness in Cross-sectional Area; Hv* | Range of Hv* in Equation (1) or (2) | Condition of Area Struck in Drop Weight Test #1 | Remarks |
|---|---|---|---|---|---|---|
| 30 | 3.3 mm thick, Formed with a curvature of 150R | " | 130* | 150~209 | ▼ | T.C. |
| 31 | 3.3 mm thick, Formed with a curvature of 150R | " | 159* | 172~229 | ▼ | T.C. |
| 32 | 3.3 mm thick, Formed with a curvature of 150R | " | 191* | 200~250 | ▼ | T.C. |
| 33 | 3.3 mm thick, Formed with a curvature of 150R | " | 217* | 228~255 | ▼ | T.C. |
| 34 | 3.3 mm thick, Formed with a curvature of 150R | " | 233 | Not applied | Δ | T.C. |
| 35 | 3.3 mm thick, Formed with a curvature of 150R | Cold reduced 20% → As-bent | 232 | 203~253 | ○ | E.I. |
| 36 | 3.3 mm thick, Formed with a curvature of 150R | Cold reduced 10% → As-bent | 242 | 212~250 | ▼ | T.C. |
| 37 | 3.3 mm thick, Formed with a curvature of 150R | Cold reduced 10% → As-bent | 252 | 202~252 | ▼ | T.C. |
| 38 | 3.3 mm thick, Formed with a curvature of 150R | Cold reduced 20% → Annealed at 400° C. for one hour → Bent | 183 | 172~229 | ○ | E.I. |
| 39 | 3.3 mm thick, Formed with a curvature of 150R | Cold reduced 20% → Bent to 300R → Annealed at 400° C. for one hour, with intermediate annealing → Bent to 150R | 185 | " | ○ | E.I. |
| 40 | 3.3 mm thick, Formed with a curvature of 150R | Orthogonally cold reduced 20% #2 → Annealed at 400° C. for one hour → As-bent | 182 | " | ○ | E.I. |
| 41 | 3.3 mm thick, Formed with a curvature of 150R | Orthogonally cold reduced 40% #2 → Annealed at 500° C. for one hour → As-bent | 176 | " | ○ | E.I. |
| 42 | 3.3 mm thick, Formed with a curvature of 150R | Orthogonally cold reduced 40% #2 → Annealed at 650° C. for twp hours → Cold reduced 10% → As-bent | 179 | " | ○ | E.I. |
| 43 | 3.3 mm thick, Formed with a curvature of 150R | Orthogonally cold reduced 10% #2 → As-bent | 177 | " | ○ | E.I. |
| 44 | 3.3 mm thick, Formed with a curvature of 150R | Orthogonally cold reduced 40% #2 → As-bent | 202 | " | ○ | E.I. |
| 45 | 3.3 mm thick, Formed with a curvature of 150R | Orthogonally cold reduced 70% #2 → As-bent | 245* | " | ▼ | T.C. |
| 46 | 3.3 mm thick, Formed with a curvature of 150R | Orthogonally cold reduced 40% #2 → Annealed at 650° C. for twp hours → Cold reduced 10% → As-bent | 168 | 164~222 | ○ | E.I. |
| 47 | 3.3 mm thick, Formed with a curvature of 150R | Annealed → As-bent | 239 | Not applied | ▼ | T.C. |
| 48 | 3.3 mm thick, Formed with a curvature of 150R | " | 258 | " | Δ | T.C. |

*: Outside the scope of this invention
T.C.: Tested for comparison
E.I.: Embodiment of the invention
#1 Condition of the Area Struck in the Drop Weight Test:
▼: The falling weight passed through the specimen.
Δ: The falling weight did not pass through the specimen but produced a crack.
○: The falling weight neither passed through the specimen nor produced a crack.
#2 Orthogonal cold reduction is the cold reduction perpendicular to the direction in which the strip from which the specimen was taken had been rolled prior to the application of preforming.
Cold reduction is the cold direction in the same direction as the one applied to the strip prior to performing.

Specimens Nos. 1, 5, 8, 9, 13, 16, 19, 23, 26, 29 to 33, and 45 in Tables 1 to 4 were tested for the purpose of comparison. While the total concentration S of oxygen, nitrogen and carbon and the iron concentration were all within the range of this invention, Vickers hardnesses Hv* in the cross-sectional area were outside the range of this invention. In the drop-weight test, harder titaniums with excessive work-hardening and insufficient ductility failed to deform under impact, with the resulting crack propagating to allow the penetration of the falling weight. Softer titaniums with small impact resistance, on the other hand, developed localized deformation leading to the penetration of the falling weight.

By comparison, embodiments Nos. 2 to 4, 6, 7, 10 to 12, 14, 15, 17, 18, 20 to 22, 24, 25, 35, 38 to 45, and 47 had the total concentration S of oxygen, nitrogen and carbon, iron concentration and Vickers hardness Hv* in the cross-sectional area after work-hardening in the ranges according to this invention. With the application of appropriate work-hardening, the embodiments of this invention did not allow the penetration of the falling weight in the drop-weight test. The impact resistances of the embodiments proved to be equal to or greater than those of specimens Nos. 47 and 48 of titanium alloys comprising Ti-3Al-2.5V and Ti-15V-3Cr-3Sn-3Al.

The total concentrations S of oxygen, nitrogen and carbon in specimens Nos. 27, 28 and 34 tested for comparison were in excess of 0.28 mass percent and above the range of this invention. The iron concentrations in specimens Nos. 36 and 37 were in excess of 0.15 mass percent and also above the range of this invention. The results of the drop-weight test on the above specimens showed little sign of improvement in impact resistance by work-hardening.

The total concentrations S of oxygen, nitrogen and carbon, iron concentrations, and Vickers hardnesses Hv* in the cross-sectional area after work-hardening in specimens Nos. 38 to 41 to which a combination of preliminary working and annealing was applied prior to bending and specimens Nos. 40 to 44 to which cold rolling was applied perpendicular to the rolling direction of the strip were within the ranges according to this invention. With application of appropriate work-hardening, the above specimens did not allow the penetration of the falling weight in the drop-weight test.

Cold rolling was applied in the same direction as the direction of rolling of the strip to specimen No. 14 and perpendicular to the direction of rolling of the strip to specimen No. 46. Both specimens were subjected to cold rolling immediately before bending with a reduction ratio of 10 percent and had substantially equal hardnesses. Although both specimens did not allow the penetration of the falling weight in the drop-weight test, crack developed in specimen No. 14 to which cold rolling was applied in the same direction as the direction of the rolling of the strip and not in specimen No. 46 to which cold rolling was applied perpendicular to the direction of rolling of the strip. Thus, specimen No. 46 had a greater impact resistance than specimen No. 14.

As described above, this invention provides titaniums having excellent impact resistance and methods for manufacturing such titaniums by attaining good cold workability by controlling the concentrations of oxygen, nitrogen, carbon and iron contained in ordinary pure titaniums in the desired range, applying combinations of preliminary working and annealing before or during the forming process, and controlling the Vickers hardness in the cross-sectional area to the desired range according to the concentrations, without adding aluminum, molybdenum, vanadium or other alloying elements.

What is claimed is:

1. Titanium having impact resistance consisting essentially of total concentration S of oxygen, nitrogen and carbon, [O], [N], and [C], between 0.04 and 0.27 mass percent, not more than 0.1 mass percent iron, substantially no copper, and the balance being titanium and unavoidable impurities, and having Vickers hardness Hv* controlled by work-hardening to the range satisfying one of the following equations (1), (2) and (3):

when $0.04 \leqq S \leqq 0.09$ (mass percent)

$$150 \leqq Hv^* \leqq 400 \times S + 175 \quad (1)$$

when $0.09 \leqq S \leqq 0.20$ (mass percent)

$$510 \times S + 104 \leqq Hv^* \leqq 400 \times S + 175 \quad (2)$$

when $0.20 \leqq S \leqq 0.27$ (mass percent)

$$510 \times S + 104 \leqq Hv^* \leqq 255 \quad (3)$$

wherein S: [O]+[N]+[C] (mass percent)

Hv*: Vickers hardness in the cross-sectional area of the work-hardened product.

2. A method for manufacturing the titanium with impact resistance according to claim 1 in which preliminary working is applied before forming so that Vickers hardness Hv* in the cross-sectional area of the formed product satisfies one of said equations (1), (2) and (3).

3. A method for manufacturing the titanium with impact resistance according to claim 2 in which the preliminary working applied before forming so that Vickers hardness Hv* in the cross-sectional area of the formed product satisfies one of said equations (1), (2) and (3) comprises either or both of rolling with rolls applied in a direction perpendicular to the direction of hot- or cold-rolling applied prior to said preliminary working.

4. A method for manufacturing the titanium with excellent impact resistance according to claim 2 in which annealing is applied before or during forming so that Vickers hardness Hv* in the cross-sectional area of the formed product satisfies one of said equations (1), (2) and (3).

* * * * *